US008245334B2

(12) United States Patent
Cohen

(10) Patent No.: US 8,245,334 B2
(45) Date of Patent: Aug. 21, 2012

(54) DUVET COVER

(76) Inventor: Grahame Keith Cohen, London (GB)

( * ) Notice: Subject to any disclaimer, the term of this patent is extended or adjusted under 35 U.S.C. 154(b) by 0 days.

(21) Appl. No.: 12/854,430

(22) Filed: Aug. 11, 2010

(65) Prior Publication Data

US 2011/0035881 A1 Feb. 17, 2011

(30) Foreign Application Priority Data

Aug. 12, 2009 (GB) ..... 0914084.9

(51) Int. Cl.
*A47C 9/00* (2006.01)

(52) U.S. Cl. ..... 5/501; 5/482

(58) Field of Classification Search ..... 5/482, 490, 5/500–502

See application file for complete search history.

(56) References Cited

U.S. PATENT DOCUMENTS 3,331,088 A * 7/1967 Marquette ..... 5/502
4,802,251 A 2/1989 O'Dell
4,839,934 A * 6/1989 Rojas ..... 5/502
6,243,896 B1 * 6/2001 Osuna et al. ..... 5/502
6,698,043 B2 * 3/2004 Fabian ..... 5/486
6,968,582 B1 11/2005 Barton et al.

FOREIGN PATENT DOCUMENTS

| | | | |
|---|---|---|---|
| DE | 29822307 | U1 | 3/1999 |
| EP | 1082928 | | 3/2001 |
| GB | 2296864 | | 7/1996 |
| GB | 2296864 | A | 7/1996 |
| GB | 2303062 | | 2/1997 |
| GB | 2303062 | A * | 2/1997 |
| GB | 2336775 | | 11/1999 |
| GB | 2369293 | A | 5/2002 |
| JP | 2002-325668 | | 11/2001 |

OTHER PUBLICATIONS

Search Report issued in corresponding UK Application No. GB 0914084.9 mailed Dec. 11, 2009.

* cited by examiner

*Primary Examiner* — Fredrick Conley
(74) *Attorney, Agent, or Firm* — Leason Ellis, LLP

(57) ABSTRACT

A duvet cover (10) comprising a pair of pouches (30, 40) joined by an upper duvet cover body (20). Each pouch is arranged to accommodate a duvet and has an area (35, 45) free from the upper duvet cover body towards the centre of the duvet cover.

8 Claims, 10 Drawing Sheets

Fig. 3

DUVET COVER

The present invention relates to a duvet cover and in particular to a duvet cover for two people.

Duvet covers are sometimes referred to as quilt covers. The term 'duvet' is commonly used to refer to either the inner duvet covered by the duvet cover or just the inner duvet or quilt alone. Duvets are also known as comforters and continental quilts.

Existing duvet covers shared by a couple are usually two pieces of rectangular material sewn together to form a singular pouch with an opening at one end through which the duvet is inserted. The opening usually has press-stud type poppers, hook and loop fasteners or other means of fastening to retain the duvet inside the cover. Duvets and duvet covers are available in various matching sizes.

These existing duvets suffer from various common and inherent problems.

For example, where a bed is shared by a couple, a double duvet or larger is used to provide coverage for both occupants. It is common for one person in a couple to desire a different thickness (tog) of duvet to the other. One manner of addressing this is by use of so-called 'couples duvets' in which two smaller (typically single sized) duvets are connected together and then used as a regular double duvet. A particular limitation with couples duvets is that regular duvets cannot be used as they lack the fasteners, zips etc to link to another duvet. As there is only a very limited market for such couples duvets, there is limited choice and those requiring non-allergenic, man-made fibre or duck down duvets may be unable to find something to fit their needs.

A further and more critical issue with all duvets shared between couples is that an air gap exists between the couple when in bed and overlaid by a conventional (or so-called 'couple') duvet. This air gap allows draughts to enter beneath the duvet and for heat to escape from the duvet. Furthermore, additional heat loss may be accentuated by the air gap when one person repositions the duvet by pulling it. This action tends to tighten the duvet between the couple and opens up air flow between them.

The only currently known way to solve all these problems together is to use two separate unconnected duvets, one for each of the couple. However, when the bed is made, this prevents the preferable clean lines of a single duvet cover over the bed.

The present invention seeks to improve on existing duvets for couples by seeking to solve these problems.

According to an aspect of the present invention, there is provided a duvet cover as claimed in claim 1.

In embodiments of the present invention, a common duvet cover body accommodates a separate duvet for each individual in a pouch, each pouch having a free side towards the centre of the duvet to define a free area. In this manner it is possible for each of a couple to wrap themselves in their duvet in their pouch from both sides, to thereby regulate the temperature under the duvet and provide a snug feeling.

The pouches may be adjacent, overlap or may be spaced apart. In embodiments in which the pouches are spaced apart, the upper duvet cover body preferably provides slack in the spaced apart area when in use such that one party can move without pulling on the pouch of the other.

Preferred embodiments of the present invention seek to provide a duvet cover in which the pouches overlap to allow standard single duvets to be used on various sized beds. In this manner, the duvet cover does not become too large for the bed size. The duvet cover also enables couples to sleep closely together and yet have the benefit of individual duvets by virtue of the pouches. The level of overlap is determined by the size of the duvet cover to match the bed size, a larger overlap may be used for smaller bed sizes.

In an alternative preferred embodiment, a duvet cover is provided in which the pouches lie substantially adjacent such that there is no excess bulk in the middle of the duvet cover from overlapping duvets. This embodiment may require a wider duvet cover, depending on the size of the duvets to be accommodated, however this can enable the duvet cover to act like an attractive bedspread when not in use.

Preferably, each pouch is aligned such that three of its four sides are substantially adjacent sides of the duvet cover body. Preferably, the fourth side of each the pouch is free from the duvet cover body. Preferably, at least portions of the first and third sides of each pouch are free from the duvet cover body, the first and third sides being adjacent the fourth side. Preferably, the free area is contiguous and spans the entire length of the pouch. Preferably, the area is rectangle and comprises approximately 15-25% (or larger) of the pouch.

Embodiments of the present invention will now be described in detail, by way of example only, with reference to the accompanying drawings in which.

The duvet cover 10 comprises an upper duvet cover body 20 and a pair of pouches 30, 40 joined to the upper duvet cover body 20.

Figure 14:
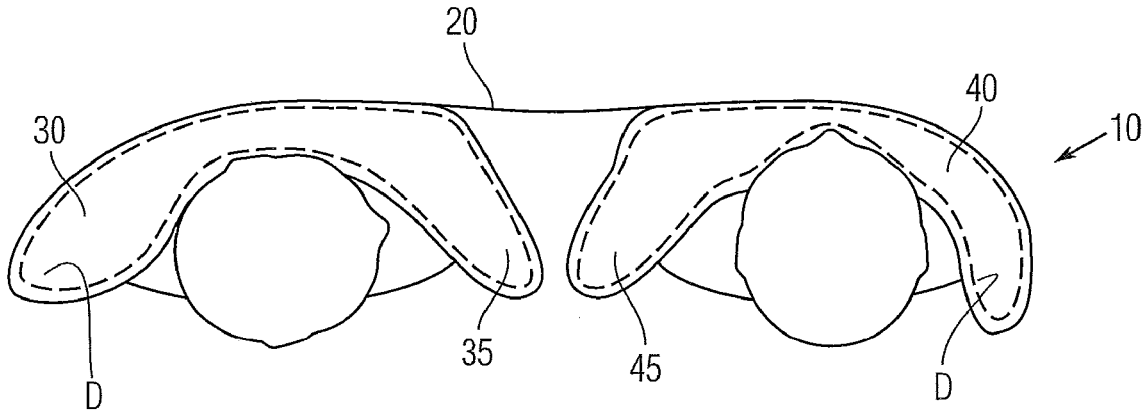
FIG. 14 is a perspective view of an embodiment of the present invention when in use.

Each pouch 30, 40 is aligned so as to coincide with an occupant of a bed and is sized and arranged to accommodate a conventional sized duvet D (see FIG. 14). In this manner, a conventional sized duvet can be selected by each occupant (potentially of different tog rating and/or filling type—or even of the electric blanket type). The upper duvet cover body 20 overlays the two pouches 30, 40 to form what appears, when the duvet cover is positioned on a bed, to be a conventional duvet cover 10. However, the underside of the duvet cover differs from a conventional duvet cover in that at least a portion 35, 45 of each pouch 30, 40 is free from the upper duvet cover body 20, thereby forming a flange-like projection 35, 45 that can be wrapped around the respective occupant.

It will be appreciated that non-standard sized duvets (and corresponding pouch sizes) could be specified in cases where the intention is for the duvet cover to match the size of regular duvet covers.

Figure 3:
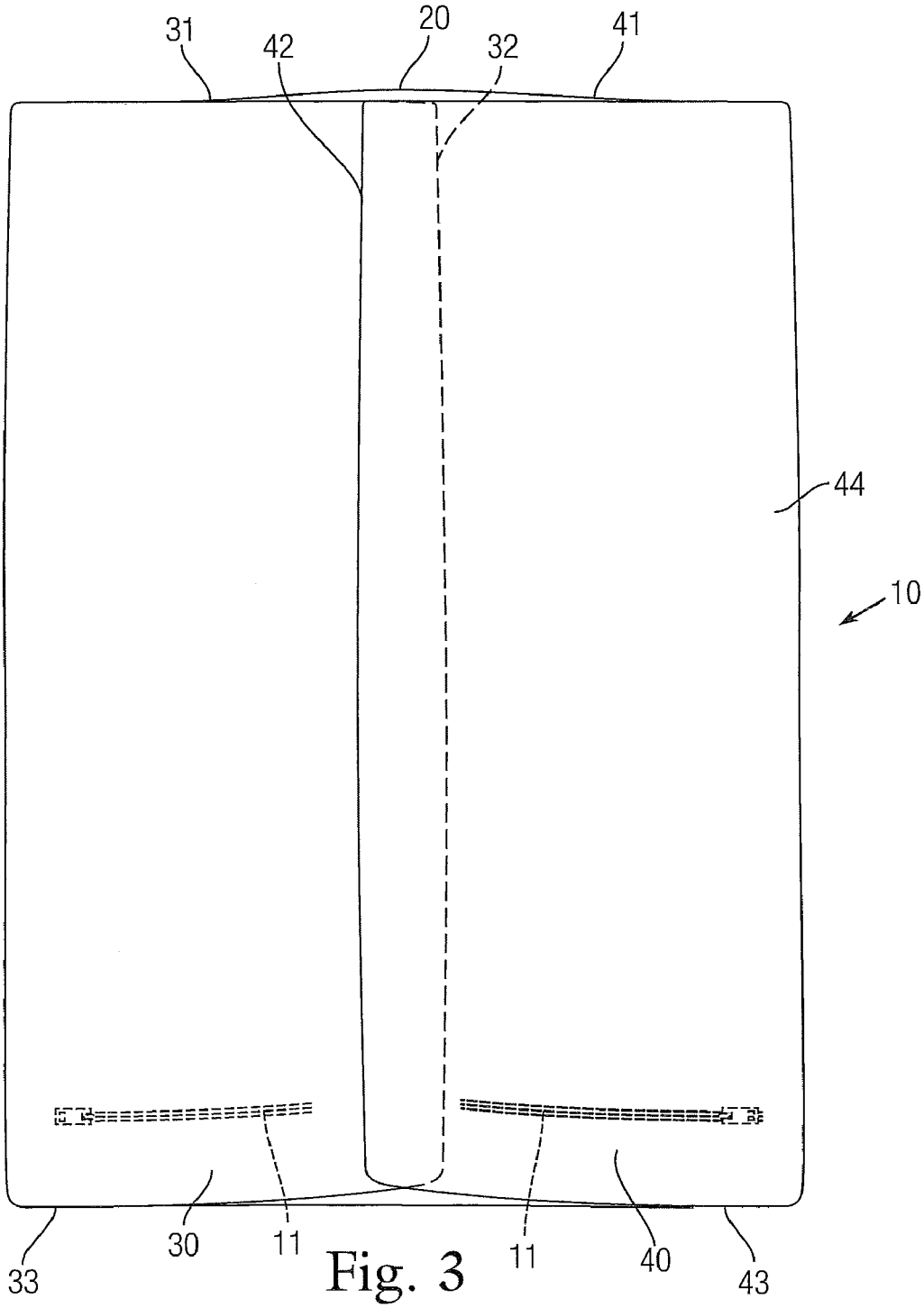
FIG. 3 is a sectional (underneath) view of the embodiment of FIGS. 1 and 2.

In this embodiment, the pouches 30, 40 and upper duvet cover body 20 are arranged such that there is an overlap between the two inside edges of the pouches when the duvet cover is flat on the bed (as shown in FIG. 3). The size of this overlap will vary depending on the size of the duvet cover. Preferably, it will be possible to use the duvet cover with standard size single duvets.

Preferably, the free portion comprises approximately 15-25% (or larger) of the surface area of the pouch.

The upper duvet cover body 20 in one embodiment is a rectangular piece of material. In one embodiment, the underside of the duvet cover is made of three separate rectangular pieces of material, arranged so as to form separate pouches 30, 40 when stitched to the upper duvet cover body 20. Alternatively, the underside of the duvet cover may be made of two separate rectangular pieces of material, each creating a separate pouch 30, 40, each pouch sized to house a standard single duvet.

In another embodiment of the invention the upper duvet cover body and pouches are formed from a single continuous piece of material that is sewn together to create the duvet cover with the upper cover body forming the visible part of the duvet cover when on a bed and the two pouches underneath for accommodating a separate duvet for each occupant.

The pouch 30 is preferably formed so that it has exterior edges 31, 33, 34 substantially adjacent edges 21, 22, 24 of the upper duvet cover body 20. Similarly, the pouch 40 is preferably formed so that it has exterior edges 41, 43, 44 substantially adjacent edges 22, 23, 24 of the upper duvet cover body 20. The inside edge 32, 42 of each pouch has at least a portion which remains free from the upper duvet cover body 20.

This free area 35, 45 on the inside edge 32, 42 of each pouch 30, 40 allows each person to be individually covered (as shown in FIG. 14) and, if the overall duvet 10 is moved or pulled, the interior edge of the person's duvet will remain substantially in position on the bed ensuing minimum loss of heat for each person and therefore maximum comfort.

It will be appreciated that the ability to put in a single duvet into each pouch allows each person, should they so desire, to select a different material, thickness or tog rating of duvet.

It will also be appreciated that the edges of the pouches may be offset from the edges of the upper duvet cover body 20 in selected embodiments. Each exterior edge of each pouch will nevertheless still be substantially parallel to the corresponding offset edge of the duvet cover body 20.

When placed on the bed and viewing from the top the duvet appears as one piece, consistent with the contiguous visual lines of existing duvet covers despite the benefits of the two pouches underneath.

By way of example only, dimensions for the embodiment described in FIGS. 1 to 3 may be as follows. Each pouch 30, 40 may be sized to accommodate a conventional single duvet and thus may be 130 cm wide. The free area forming the flange-like projections 35, 45 may be 44 cm wide, and in this case the portion of the pouches 30, 40 which is joined to the upper duvet cover body 20 may be 86 cm wide. The spacing between the two points at which the flange-like projections 35, 45 become joined to the upper duvet cover body may be 50 cm, such that there is an overlap between the flange-like projections 35, 45 of the pouches 30, 40 when the duvet cover is flat on a bed. In this example, the duvet cover 10 would measure 222 cm (i.e. 86+50+86 cm) wide.

Figure 4:
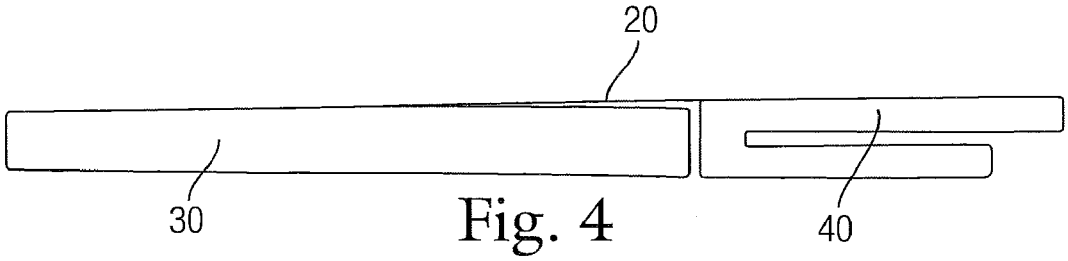
FIG. 4 is a sectional view of an optional arrangement of the embodiment of FIGS. 1 to 3.

Conveniently, if the pair of duvets used in the pouches 30, 40 are of different thicknesses then when the bed is made one of the pouches free area can be folded back on itself to increase its bulk as shown in FIG. 4. In an optional embodiment in which there are overlapping free areas of pouches as described above, the pouches are arranged such that the free edge 32 or 42 of one of the pouches, when laid flat, is substantially adjacent the point at which the free area of the other pouch is joined to the upper duvet cover body 20. In this manner, if the duvet of lesser thickness is folded back on itself (as shown in FIG. 4), the increased thickness from folding compensates for the thickness of the other duvet and the duvet 10 appears of uniform thickness and the pouches would be imperceptible when the duvet cover 10 is not in use. Additionally as the duvet hangs over the bed at the sides where there a thickness difference remains it has no significant visual effect.

Figure 5:
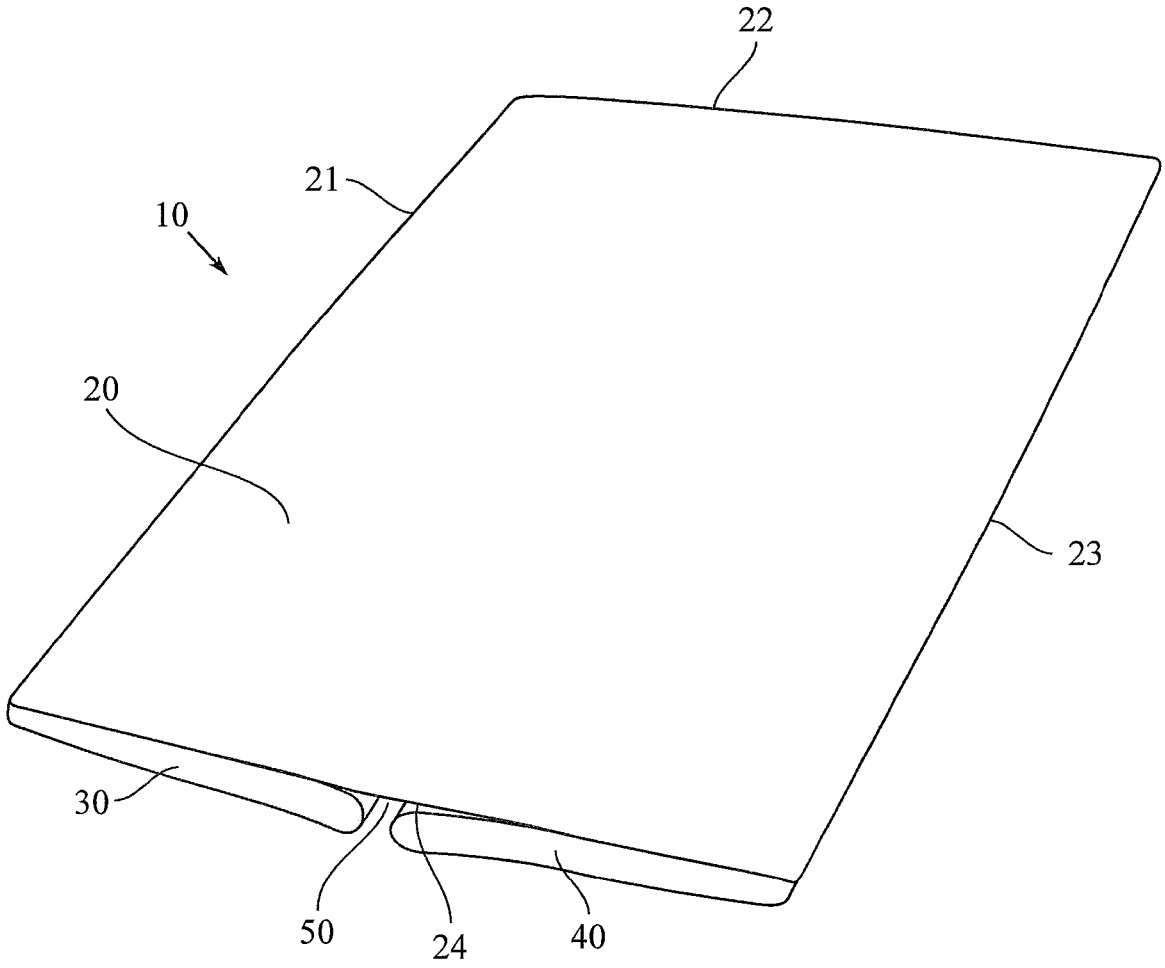
FIG. 5 is a perspective view of a duvet cover according to another embodiment of the present invention.
Figure 6:
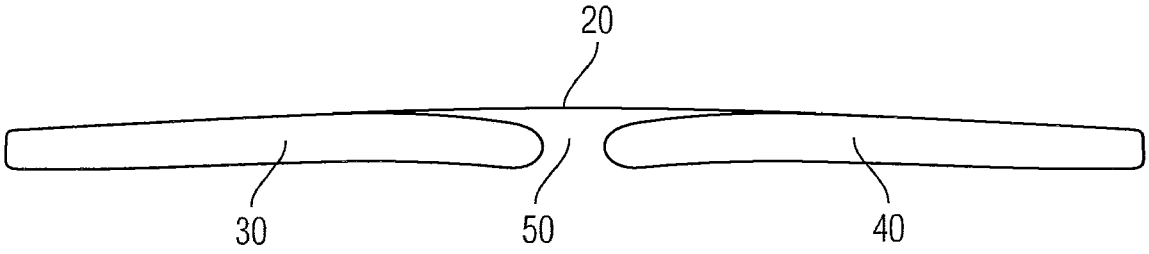
FIG. 6 is a cross-sectional view of the embodiment of FIG. 5.

FIG. 5 is a perspective view of a duvet cover according to another embodiment of the present invention. FIG. 6 is a cross-sectional view of the embodiment of FIG. 5 and FIG. 7 is a sectional (underneath) view of the embodiment of FIGS. 5 and 6.

Figure 1:
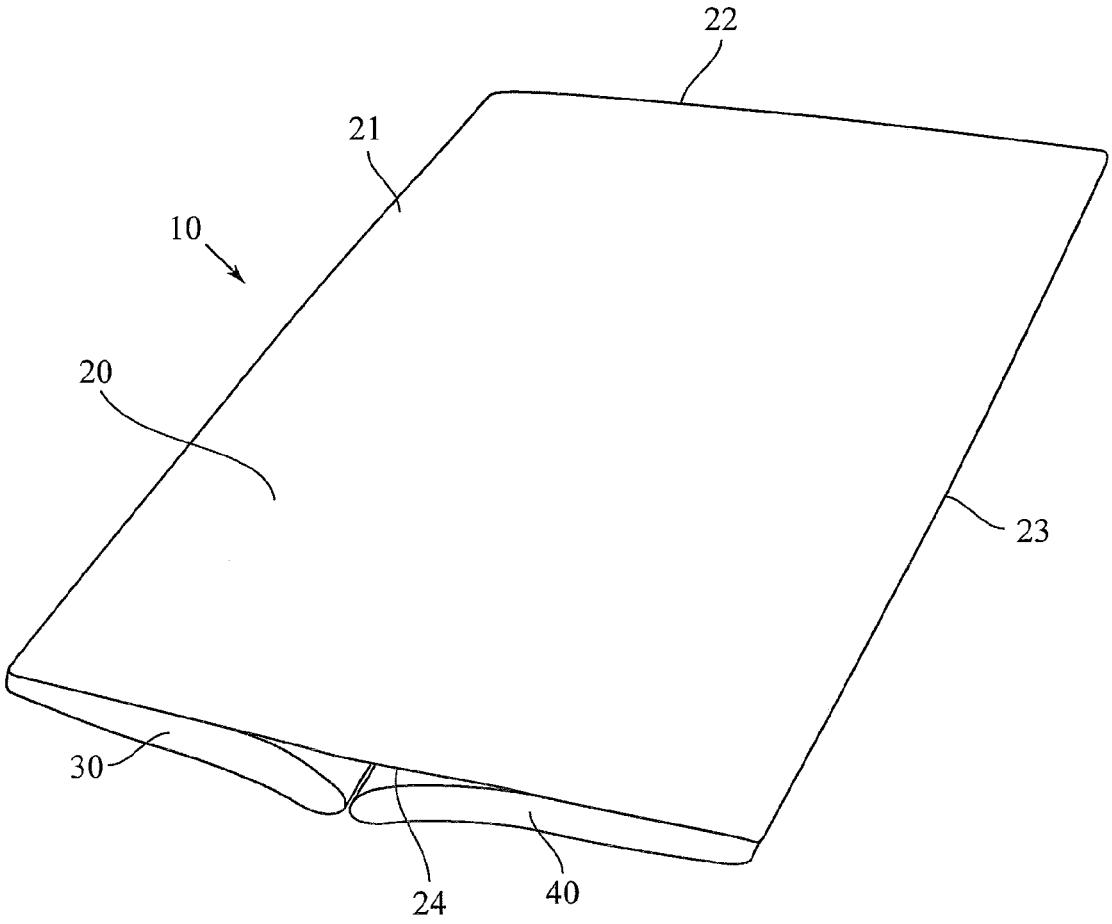
FIG. 1 is a perspective view of a duvet cover according to an embodiment of the present invention.
Figure 2:
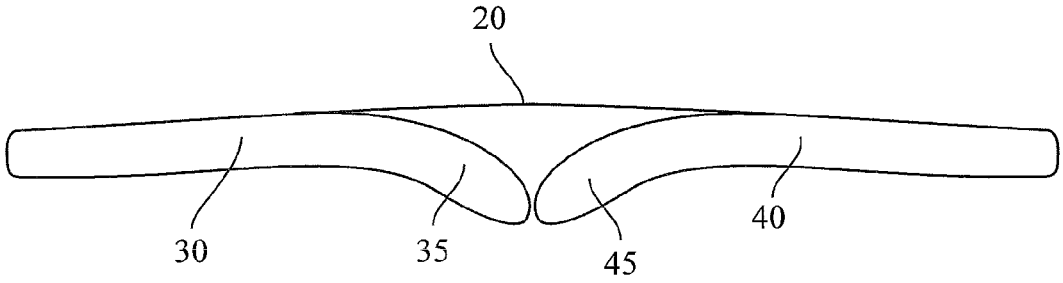
FIG. 2 is a cross-sectional view of the embodiment of FIG. 1.
Figure 7:
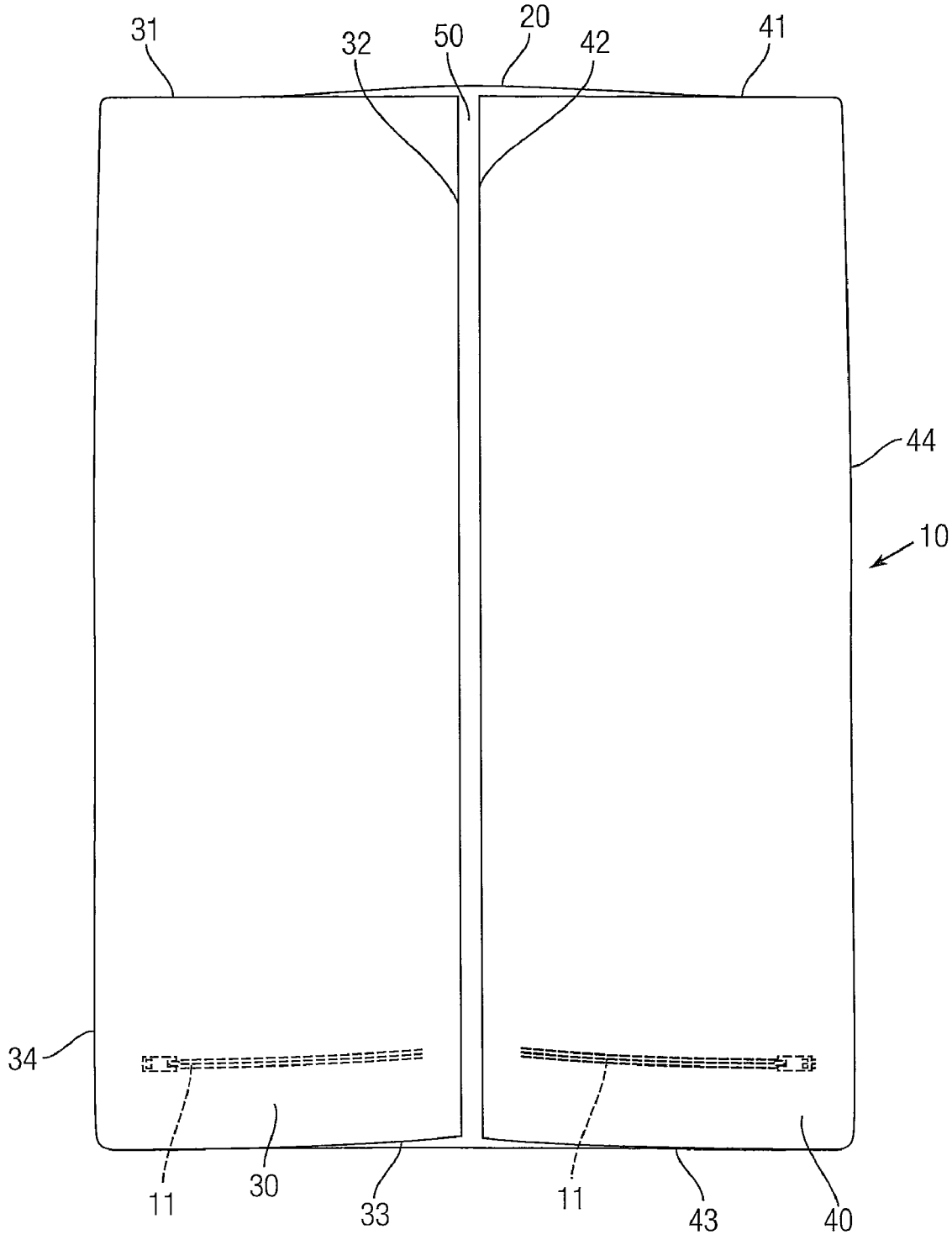
FIG. 7 is a sectional (underneath) view of the embodiment of FIGS. 5 and 6.

The embodiment of FIGS. 5 to 7 differs from that of FIGS. 1 to 3 in that there is a gap 50 between the two free inside edges 32, 42 of the pouches 30, 40. The gap 50 allows for flexibility should the couple move further apart in the night, enabling each to maintain the position of their independent pouches 30, 40 containing their duvets (the material of the upper duvet cover body 20 creating the gap 50 and will take up any tension from the other member of the couple tugging the cover away).

It will be appreciated that the arrangement illustrated in FIG. 4 is also applicable to the embodiment of FIGS. 5 to 7.

Figure 8:
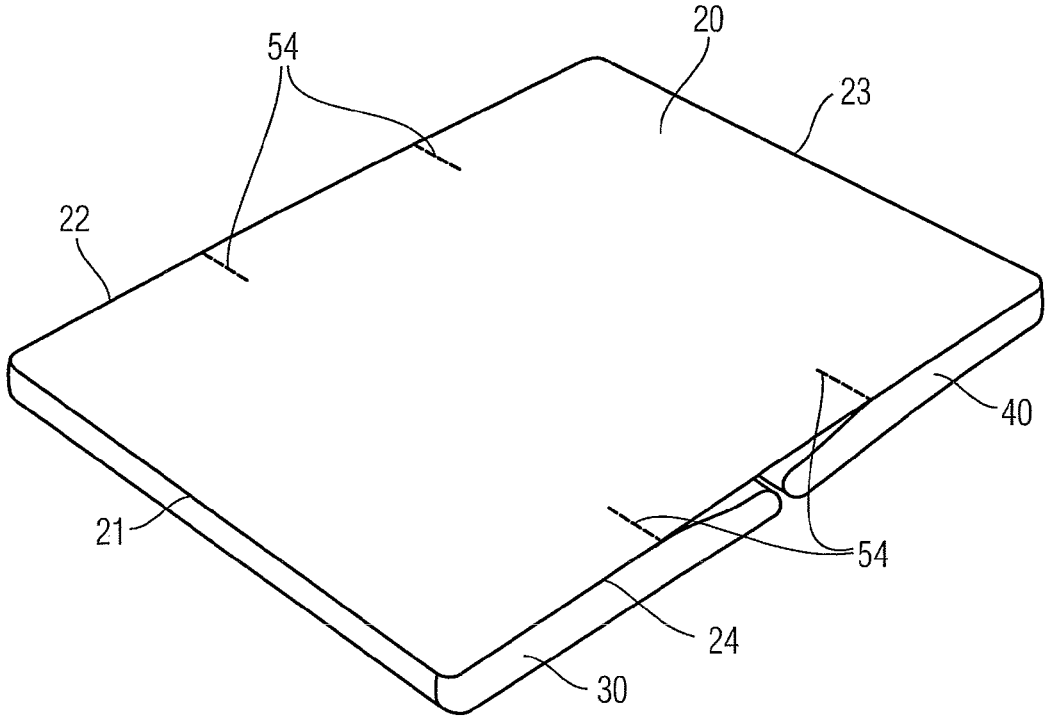
FIG. 8 is a perspective view of a duvet cover according to a further embodiment of the present invention.
Figure 9:
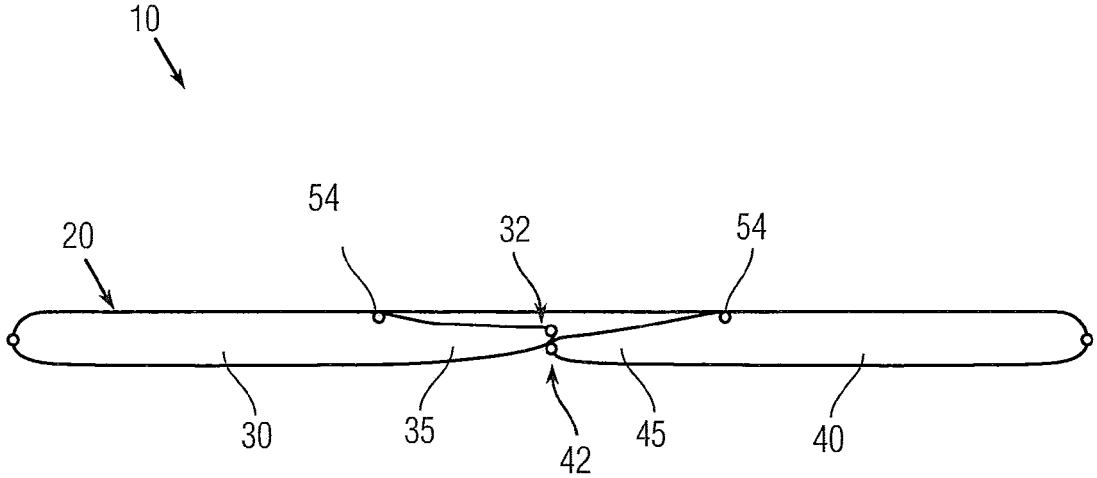
FIG. 9 is cross-sectional view of the embodiment of FIG. 8.
Figure 10:
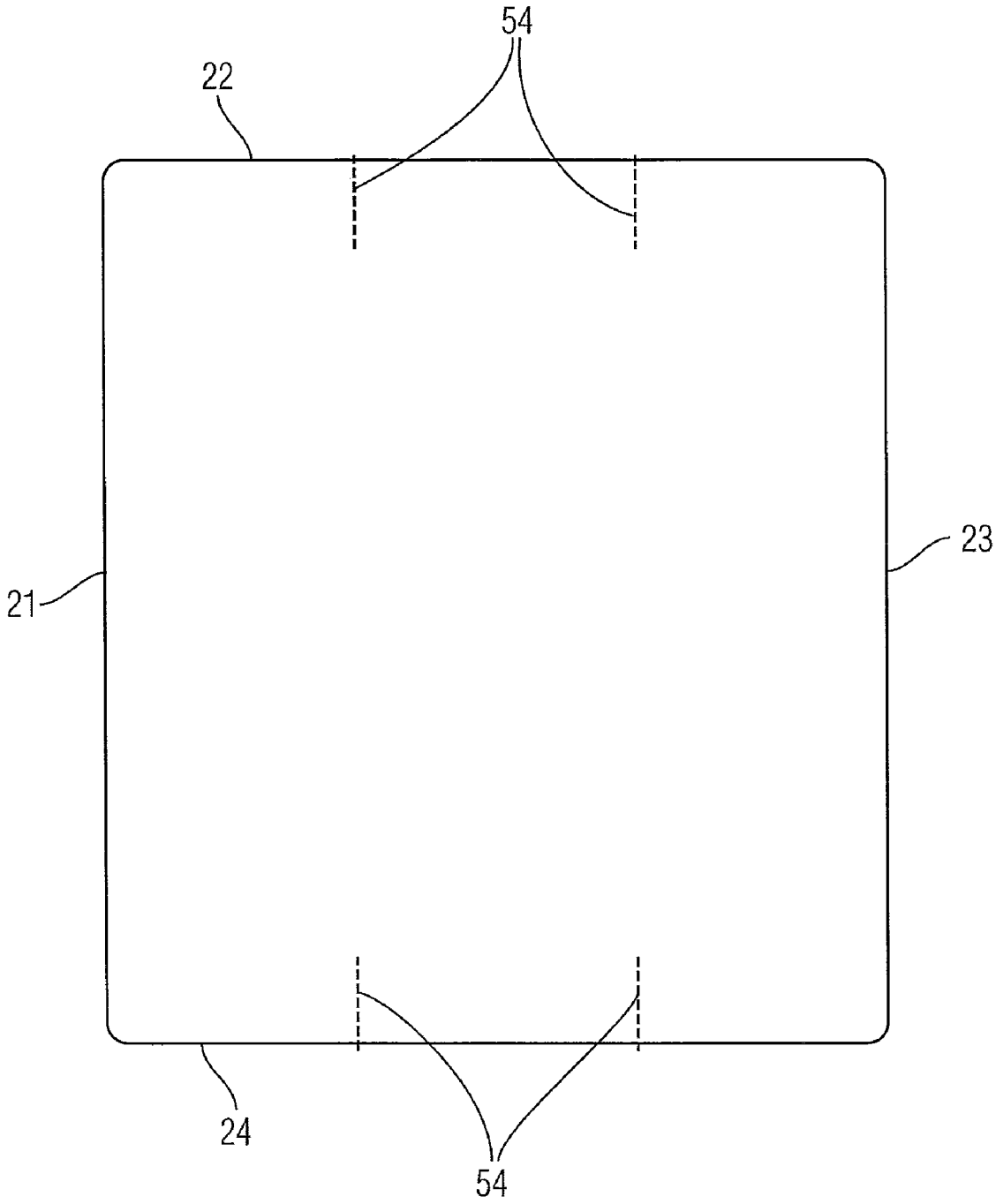
FIG. 10 is a sectional (plan) view of the embodiment of FIGS. 8 and 9.
Figure 11:
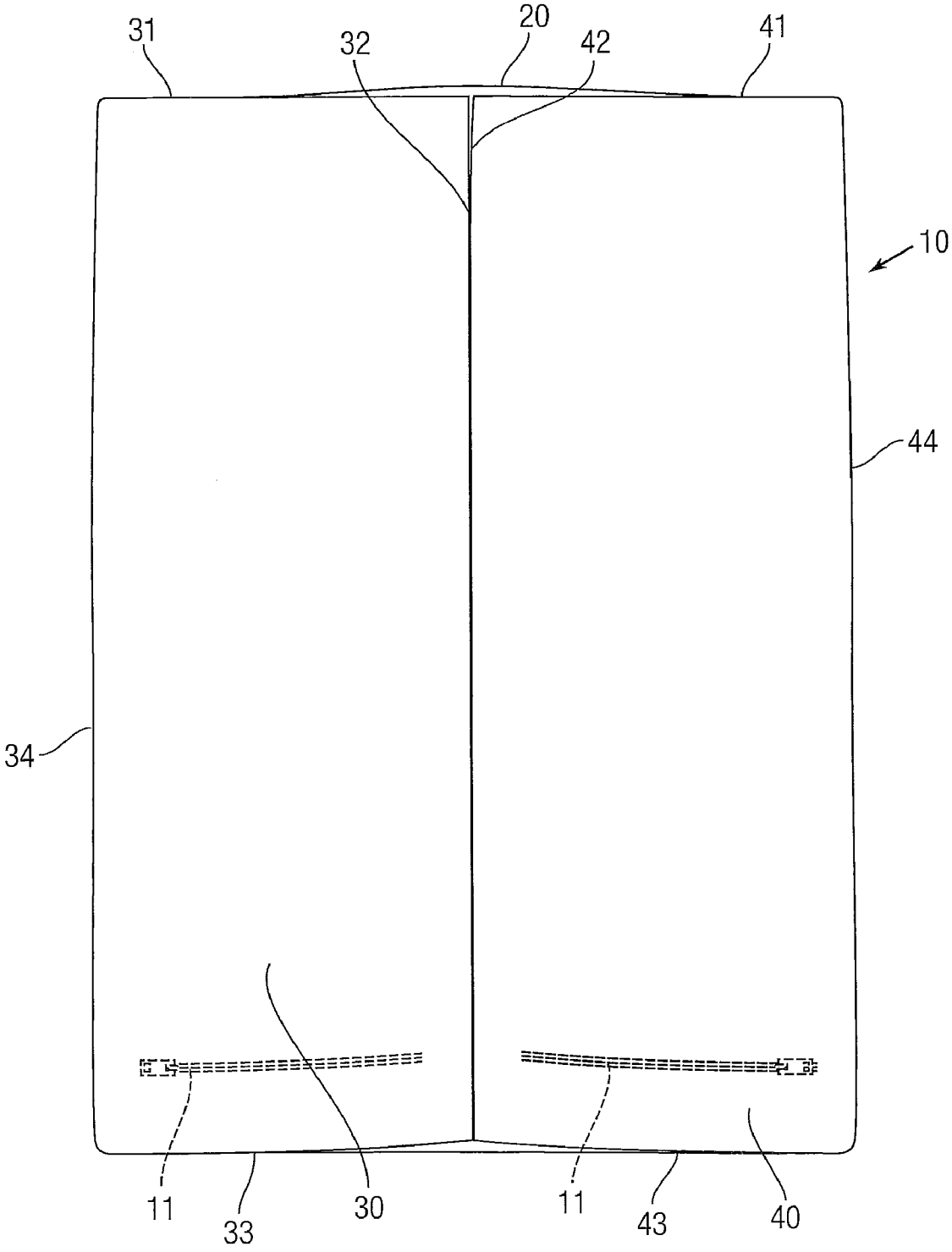
FIG. 11 is a sectional (underneath) view of the embodiment of FIGS. 8 to 10.

FIG. 8 is a perspective view of a duvet cover according to a further embodiment of the present invention. FIG. 9 is a cross-sectional view of the embodiment of FIG. 8, FIG. 10 is a sectional (plan) view of the embodiment of FIGS. 8 and 9, and FIG. 11 is a sectional (underneath) view of the embodiment of FIGS. 8 to 10.

As with the previously described embodiments, the embodiment described in FIGS. 8 to 11 comprises two pouches 30, 40 which are preferably formed so that the pouch 30 has exterior edges 31, 33, 34 substantially adjacent the edges 21, 22, 24 of the upper duvet cover body 20, and that the pouch 40 has exterior edges 41, 43, 44 substantially adjacent the edges 22, 23, 24 of the upper duvet cover body 20. However the embodiment of FIGS. 8 to 11 differs from the previously described embodiments in that the free inside edges 32, 42 of the pouches 30, 40 are proximal such that the flange-like projections 35, 45 of the pouches 30, 40 lie substantially adjacent one another.

As the flange-like projections 35, 45 lie substantially adjacent one another, there is no excess bulk due to overlapping duvets, nor any gap created by spaced apart duvets. This may be preferable as it addresses the problem of unevenness in the upper surface of the duvet cover when it is flat on a bed, which may be apparent with the previously described embodiments.

It should be appreciated that the term "adjacent" in the context of the embodiment of FIGS. 8 to 11 can include a slight overlap between the flange-like projections 35, 45. In general, the bulkiness of duvets tapers at the edges, and as such a small overlap (in the region of 2 to 3 cm) may be required in order to create a substantially continual thickness in the duvets housed in pouches 30, 40 and thus create a continual appearance for the duvet cover surface when the duvet cover is flat on a bed.

By way of example only, dimensions for the embodiment described in FIGS. 8 to 11 may be as follows. Each pouch 30, 40 may be sized to accommodate a conventional single duvet and thus may be 130 cm wide. The free area forming the flange-like projections 35, 45 may be 44 cm wide, and in this case the portion of the pouches 30, 40 which is joined to the upper duvet cover body 20 may be 86 cm wide. The spacing between the points at which the flange-like projections 35, 45 become joined to the upper duvet cover body may be 88 cm, such that the flange-like projections 35, 45 of the pouches 30, 40 lie substantially adjacent one another when the duvet cover is flat on a bed. In this example, the duvet cover 10 would measure 260 cm (i.e. 86+88+86 cm) wide.

Thus, depending on the size of the individual duvets used, the duvet cover of the embodiment of FIGS. 8 to 11 may be wider than the standard double duvet size, for example if the individual duvets are the standard single duvet size. However, in such a case, the duvet cover can act like an attractive bedspread when the bed is not in use and the bed is made.

Each pouch preferably has an opening 11 on one end and sewn closed at the other, with the open end containing fasteners such as poppers, buttons, hook and loop, a zipper or the like, to enable closing and re opening of the pouches to insert and remove the duvet for cleaning. See feature 11 in FIGS. 3, 7 and 11.

The stitching that creates the pouches 30, 40 extends towards the centre of the duvet cover from the top and bottom edges 22, 24 ("top" and "bottom" being used to refer to the ends of the duvet cover that would be adjacent a users head and feet when in use), but preferably does not run across the whole of the duvet cover from top to bottom, such that there is no visible stitching pattern running across the whole of the duvet cover when the duvet cover is in place on a bed. Such a stitching arrangement 54 can be seen in FIGS. 8 to 10. In this case, the stitching should extend towards the centre of the duvet far enough so that the pouches 30, 40 are substantial enough to contain the required duvets therein. By way of example, the stitching may extend 23 cm from the top and bottom edges 22, 24 of the duvet cover. Alternatively, the stitching 54 could extend all the way from the top to the bottom of the duvet cover, thus creating pouches 30, 40 which are fully stitched to the upper duvet cover body 20.

Figure 12:
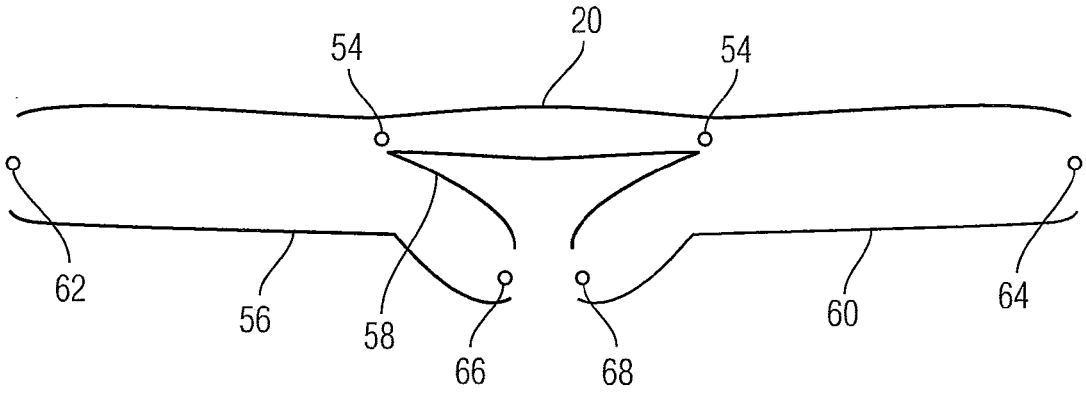
FIG. 12 is a cross-sectional view of an embodiment of the present invention showing the individual pieces of material prior to their stitching together.
Figure 13:
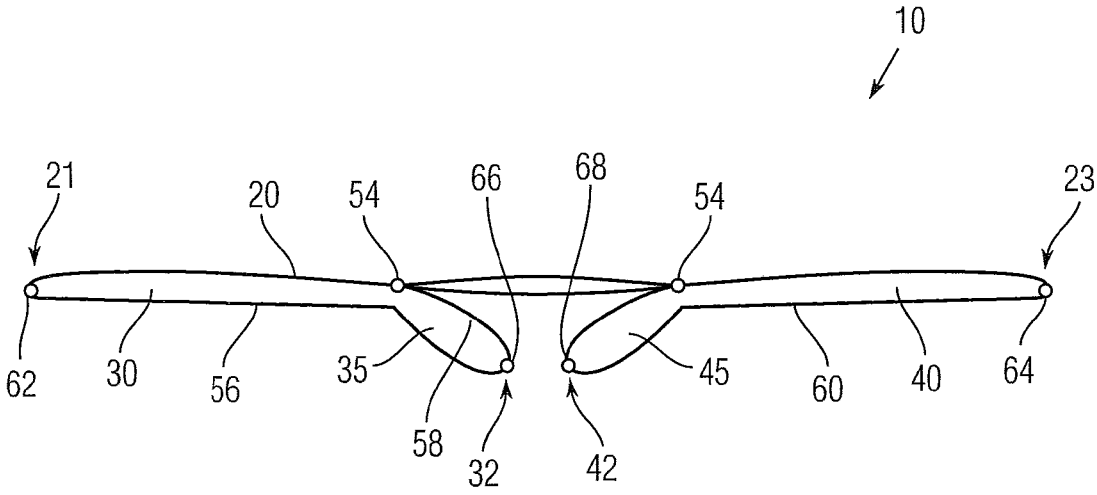
FIG. 13 is a cross-sectional view of the embodiment of FIG. 12 showing the individual pieces of material stitched together to produce the duvet cover.

FIG. 12 is a cross-sectional view of an embodiment of the present invention showing the individual pieces of material prior to their stitching together, and FIG. 13 is a cross-sectional view of the embodiment of FIG. 12 showing the individual pieces of material stitched together to produce the duvet cover.

As can be seen from FIG. 12, the duvet cover is preferably made from four pieces of material: the upper duvet cover body 20 which creates the visible upper surface of the duvet cover when in use, and three pieces of material 56, 58, 60 which form the pouches on the underside of the duvet cover when stitched together as can be seen from FIG. 13. In FIGS. 12 and 13, stitch lines which run across the whole length of the duvet cover from top to bottom are shown by a circle with a solid line, while stitch lines which do not run across the whole of the duvet cover from top to bottom are shown by a circle with dotted lines.

To form the duvet cover 10 from the constituent pieces of material 20, 56, 58, 60, the outer edges 21, 23 of the upper duvet cover body 20 are stitched to the corresponding outer edges of the pieces of material 56, 60 by stitch lines 62, 64 which run across the whole length of the duvet cover from top to bottom. The central piece of material 58 is formed into a generally triangular shape and placed in the centre of the underside of the upper duvet cover body 20 as can been seen in FIG. 12. The pouches 30, 40, and flange-like projections 35, 45 are then formed by firstly stitching the inside edges of the two pieces of material 56, 60 to the corresponding edges of the central piece of material 58 by stitch lines 66, 68 which run across the whole length of the duvet cover from top to bottom to form the inside edges 32, 42 of the respective pouches 30, 40. The pouches 30, 40 and flange-like projections 35, 45 are completed by stitching the central piece of material 58 to the upper duvet cover body 20 using stitch lines 54. Stitch lines 54 do not run across the whole of the duvet cover from top to bottom, and instead extend only part way towards the centre of the duvet cover.

It should be appreciated that the manufacturing steps used to make the duvet cover could be performed in an order other than that described above. Further, it should be appreciated that there are other ways in which the duvet cover could be manufactured, in particular by using a different number of pieces of material, and the embodiment of FIGS. 12 and 13 is shown by way of example only.

When placed on the bed and viewed from the top, the duvet appears as one piece, consistent with the visual lines of existing duvet covers despite the benefits of the two pouches underneath.

The duvet cover is preferably made available in various sizes and materials to accommodate different tastes and sizes of beds.

The invention claimed is:

1. A duvet cover, comprising:

an upper cover body having two side edges;

first and second pieces of material, each piece of material having an exterior edge, an interior edge, and defining a free edge that is independently movable relative to the upper cover body, wherein the exterior edge of each of the first and second pieces of material is fixedly attached adjacent to a respective side edge of the upper cover body, and the interior edge of each of the first and second pieces of material is attached to the upper cover body at locations that are spaced from one another and that are disposed between the first and second side edges of the upper cover, wherein a distance along the upper cover body between the exterior edge and the interior edge of each piece of material is shorter than the distance along the upper cover body between the interior edge of one of the first and second pieces of material and the exterior edge of the other piece of material;

first and second pouches defined by the attachment of the first and second pieces of material to the upper cover body, the first and second pouches being sized and shaped to receive a respective duvet and have each respective duvet removably housable so as to extend from the exterior edge to the free edge and be moveable with the free edge.

2. A duvet cover as claimed in claim 1, wherein the free edges are movable so as to overlap.

3. A duvet cover as claimed in claim 1, wherein the upper cover body and each of the first and second pouches is rectangular.

4. A duvet cover as claimed in claim 1, wherein each pouch is arranged to receive a single size duvet.

5. A duvet cover, comprising:

an upper cover body having two side edges;

first and second pieces of material, each piece of material having an exterior edge, an interior edge, and defining a free edge that is independently movable relative to the upper cover body, wherein the exterior edge of each of the first and second pieces of material is fixedly attached at a first location adjacent to a respective side edge of the upper cover body, and the interior edge of each of the first and second pieces of material is attached to the upper cover body at second locations that are spaced from one another and that are disposed between the first and second side edges of the upper cover, wherein a distance along the upper cover body between the first and second attachment locations of each respective piece of material is shorter than the distance along the upper cover body between a second attachment location of one the pieces of material and the first attachment location of the other piece of material;

first and second pouches defined by the attachment of the first and second pieces of material to the upper cover body, the first and second pouches being sized and shaped to receive a respective duvet and have each respective duvet removably housable so as to extend from the exterior edge to the free edge and be moveable with the free edge.

6. A duvet cover as claimed in claim 5, wherein the free edges are movable so as to overlap.

7. A duvet cover as claimed in claim 5, wherein the upper cover body and each Of the first and second pouches is rectangular.

8. A duvet cover as claimed in claim 5, wherein each pouch is arranged to Receive a single size duvet.

* * * * *